US005409319A

United States Patent [19]

Bedol

[11] Patent Number: 5,409,319

[45] **Date of Patent: * Apr. 25, 1995**

[54] NOTEBOOK INSERT WITH HOLEPUNCH

[76] Inventor: Mark A. Bedol, 6980 Fabriano Pl., Rancho Cucamonga, Calif. 91701

[ * ] Notice: The portion of the term of this patent subsequent to May 11, 2010 has been disclaimed.

[21] Appl. No.: 241,012

[22] Filed: May 11, 1994

[51] Int. Cl.[6] ..... B42F 3/00

[52] U.S. Cl. ..... 402/1; 402/4; 30/123

[58] Field of Search ..... 402/1, 4, 80 R; 281/30, 281/51, 15.1, 42; 30/123

[56] References Cited

U.S. PATENT DOCUMENTS

| | | | |
|---|---|---|---|
| 3,975,105 | 8/1976 | Cline | 402/1 |
| 4,729,688 | 3/1988 | Manz | 402/1 |
| 5,050,736 | 10/1991 | Bedol | 206/214 |
| 5,209,592 | 5/1993 | Bedol | 402/79 |

OTHER PUBLICATIONS

McGill, Inc., 2-piece, 3-hole binder punch, (2 photographs).

McGill, Inc., plastic base/metal hinge, 3-hole punch (2 photographs).

Day Runner, Inc. Pro TM holepunch. (2 photographs).

Day Runner, Inc. No. 043-112, 6-holepunch (2 photographs).

*Primary Examiner*—Willmon Fridie

[57] ABSTRACT

The invention is a notebook insert with a housing having a first rigid substantially flat plate having a first set of a number of spaced holes formed therethrough a first side thereof, the first set of holes being adapted for engagement with the rings of a ringed notebook. The housing further has a second set of a number of spaced holes formed therethrough a second side thereof. The housing further includes an opening in a central portion thereof. A number of spaced hinges are located on a side edge of the central portion defined by the opening. A second rigid plate has a first side hingedly connected via the spaced hinges to the first rigid plate. The second plate has a shape substantially matching the shape of the central opening so when the second rigid plate is in a stowed position it may be supported within the central opening. The second plate includes spaced projections formed on an upper surface thereof. The projections are so sized and spaced to align with the second set of spaced holes in the first plate when the second plate is rotated away from the stowed position so as to provide a holepunching capability when paper is inserted between the first plate and the second plate. Thus, the holepunch capability may be utilized without a need for removing the notebook insert from a binder it may be attached to.

6 Claims, 1 Drawing Sheet

NOTEBOOK INSERT WITH HOLEPUNCH

BACKGROUND OF THE INVENTION

1. Field of the Invention

The present invention relates to inserts for notebooks and more particularly to a notebook insert which is securable to the rings of a notebook and has a holepunch mechanism which is capable of punching paper while remaining attached to the rings of the ringed binder.

2. Description of the Related Art

Users of notebooks, including businessmen and students, often desire to have various articles such as pencils and pens at their easy disposal when they use their notebook and to be secure from being lost when they carry their notebooks from one location to another.

In partial solution to this problem, present applicant Mark A. Bedol, invented a "Notebook Organizer Including Slidable Element", U.S. Pat. No. 5,050,736. The '736 patent discloses an organizer comprising a base with holes for engagement with the rings of a ringed notebook. The base includes a plurality of partitions which divide the base into a plurality of compartments. The patent also discloses an electronic calculator having a longitudinal extension thereon being slidably engageable with, and supported between, opposing partition surfaces.

Present applicant Mark A. Bedol, has also invented "Notebook Insert With Calculator and Holepunch" U.S. Pat. No 5,209,592, which discloses a notebook insert comprising a housing, an electronic calculator attached to the housing and a holepunch assembly also attached to the housing. The housing has a periphery with multiple holes therethrough which are spaced to be adapted for engagement with the rings of a ringed notebook.

McGill, Inc. of Maringo, Ill., discloses a three-hole binder punch which is insertable into the rings of a ringed binder. This binder punch involves two pieces. A first piece inserts through the rings of the binder and a second piece, the holepunch mechanism, snaps into place on the first piece.

McGill also manufactures another three-hole paper punch under the trademark Trident. The Trident holepunch includes a plastic base with a metal hinge mechanism attached along the top surface thereof.

Day Runner, Inc., Fullerton, Calif. distributes a seven-hole punch under the trademark Pro. The Pro holepunch comprises a first plate hinge connected to a second plate, the two cooperating to form a holepunch mechanism which inserts into a ringed binder. The Pro holepunch is in a stowed position when the two plates are in cooperative engagement (i.e., the holepunch is closed). The Pro holepunch does not lie flat within the open position.

Day Runner, Inc. distributes another holepunch, a six-hole punch, Part No. 043-112. The six-hole punch cannot be used to punch paper unless it is removed from the rings of the binder.

None of the aforementioned patients provide an efficient, inexpensive means for simultaneously minimizing the space taken in a notebook binder and being capable of punching paper while remaining attached to the rings of the binder.

SUMMARY OF THE INVENTION

One embodiment of the present invention takes the form of a notebook insert with a housing comprising a first rigid substantially flat plate having a first set of a number of spaced holes formed therethrough a first side thereof, the first set of holes being adapted for engagement with the rings of a ringed notebook. The housing further has a second set of a number of spaced holes formed therethrough a second side thereof. The housing further includes an opening in a central portion thereof. A number of spaced hinges are located on a side edge of the central portion defined by the opening. A second rigid plate has a first side hingedly connected via the spaced hinges to the first rigid plate. The second plate has a shape substantially matching the shape of the central opening so when the second rigid plate is in a stowed position it may be supported within the central opening. The second plate includes spaced projections formed on an upper surface thereof. The projections are so sized and spaced to align with the second set of spaced holes in the first plate when the second plate is rotated away from the stowed position so as to provide a holepunching capability when paper is inserted between the first plate and the second plate. Thus, the holepunch capability may be utilized without a need for removing the notebook insert from a binder it may be attached to.

Other objects, advantages and novel features of the present invention will become apparent from the following detailed description when considered in conjunction with the accompanying drawings.

BRIEF DESCRIPTION OF THE DRAWINGS

The same elements or parts throughout the figures of the drawings are designated by the same reference characters.

DETAILED DESCRIPTION OF THE PREFERRED EMBODIMENTS

Figure 1:
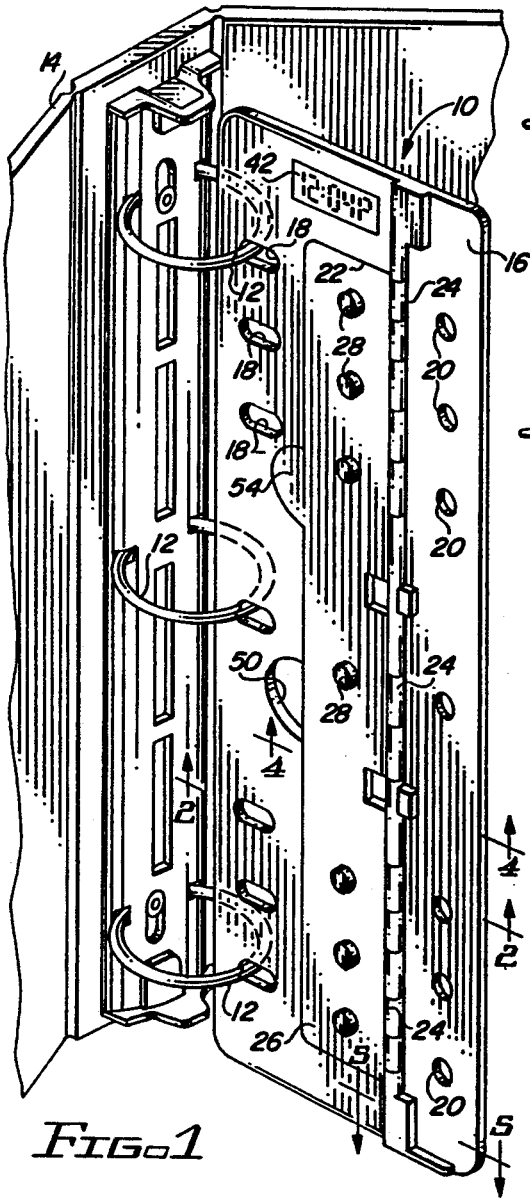
FIG. 1 is a perspective view of the notebook insert of the present invention.

Referring to the drawings and the characters of reference marked thereon, FIG. 1 illustrates the notebook insert of the present invention, designated generally as 10 shown attached to the rings 12 of a conventional ringed binder, designated generally as 14. Notebook insert 10 includes a housing 16 which comprises a first rigid, substantially flat plate. Housing or first plate 16 has a first set of a plurality of spaced holes 18 formed therethrough along a first side thereof. This first set of holes 18 are spaced and sized for engagement with the rings 12 of a ringed notebook 14, as shown. The housing (or first plate) 16 further includes a second set of a plurality of spaced holes 20 formed on a second side of the housing 16. The housing 16 further includes an opening 22 in a central portion thereof. A plurality of spaced hinges 24 are located on a side edge of the side portion defined by the opening 22.

A second rigid plate 26 has a first side hingedly connected via the spaced hinges 24 to the first rigid plate 16. The second plate 26 has a shape substantially matching the shape of the central opening 22 so that when the second rigid plate 26 is in the stowed position illustrated in FIG. 1 it may be supported within the central opening 22.

Second plate 26 includes spaced projections 28 formed on an upper surface thereof. The projections 28 are sized and spaced so as to align with the second set of spaced holes 20 in the first plate 16 when the second plate 26 is rotated away from the stowed position. Thus, a holepunching capability is provided when paper is inserted between the two plates 16, 26.

Figure 3:
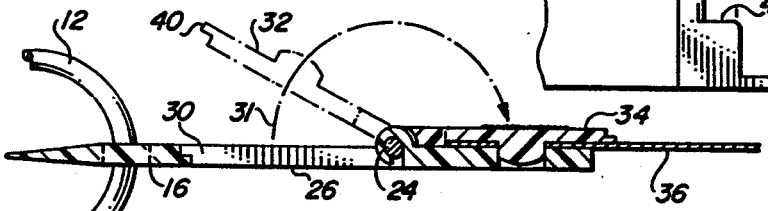
FIG. 3 is a bottom end view of the notebook insert, showing the working motion of the holepunch plate rotating to punch paper.

FIG. 3 illustrates such a sequence of operations. In the stowed position 30 the second plate 26 rests flush with the first plate 16. As the plate 26 rotates in the direction of arrow 31 it goes through an intermediate position 32 and then finally to position 34 where it cuts holes in paper 36. The notebook insert 10 of the present invention a unique capability of being utilized without a need for removing the notebook insert from the binder 14 which it is attached to.

Figure 2:
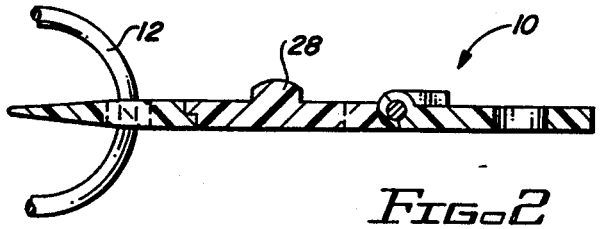
FIG. 2 is a side view of the notebook insert, partially in crosssection, taken along line 2—2 of FIG. 1.
Figure 4:
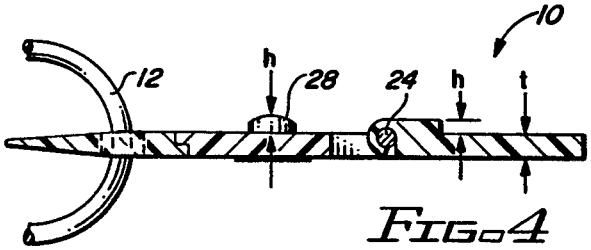
FIG. 4 is a side view of the notebook insert, partially in crosssection, taken along line 4—4 of FIG. 1.
Figure 5:
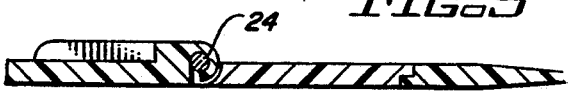
FIG. 5 is a side view of the notebook insert, partially in crosssection, taken along line 5—5 of FIG. 1.

Referring to FIGS. 2 and 4 it can be seen that the first and second plates 16, 26 each have substantially the same thickness t. Furthermore, the projections 28 and hinges 24 have substantially the same height, h. Therefore, when the notebook insert 10 is in a stowed position it has a maximum height of t plus h, thereby minimizing the maximum thickness of the notebook insert 10. (Thickness t is preferably approximately equal to height h.) The total height (h plus t) of the notebook insert 10 is approximately between 2/32 inches and ½ inch. The insert 10 is preferably formed of plastic material; however, it may be formed of metal or a glass or metal filled plastic.

A second side edge of the central portion formed by central opening 22 has a recessed portion 38 on an upper surface thereof. The second rigid plate 26 has a second side with a recessed portion 40 formed on a lower surface thereof. Recesses 38 and 40 match so that when the notebook insert 10 is in a stowed position the upper surface of the second plate 26 is maintained substantially flush with the unrecessed remaining portions of the upper surface first plate 16.

A clock 42 is preferably attached within another opening of the housing 16. Clock 42 may have multiple alarms so that it can be used as an appointment reminder. Furthermore, it may have a variety of assorted settings such as daily alarms, etc.

Tab 54 and opening 50 provide convenient opening and closing of the second plate 26.

Figure 6:
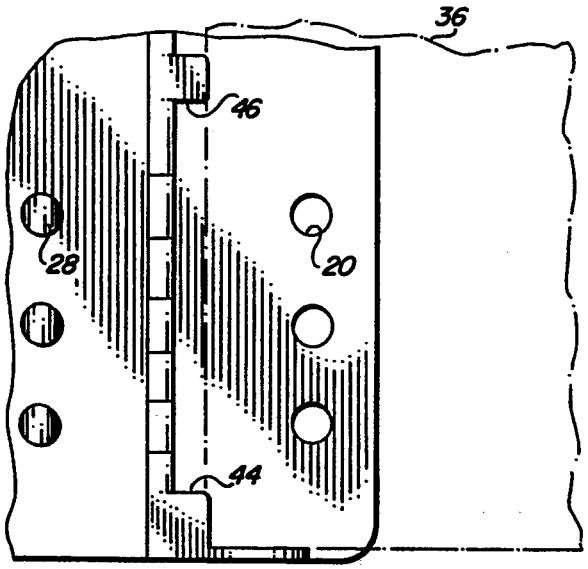
FIG. 6 is a top view of the bottom portion of the notebook insert.

Referring now to FIG. 6 can be seen that notebook insert 10 preferably also includes spaced paper positioning projections 44, 46 for assuring that the paper is maintained in the proper position for holepunching.

Unlike with most prior art devices the hinges 24 of the present invention allow the second rigid plate 26 to be rotated 180 degrees thereby minimizing the overall thickness of the apparatus 10.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A notebook insert, comprising:

(a) a housing comprising a first rigid substantially flat plate having a first set of a plurality of spaced holes formed therethrough a first side thereof, said first set of holes being adapted for engagement with the rings of a ringed notebook, said housing further having a second set of a plurality of spaced holes formed therethrough a second side thereof;

said housing further including an opening in a central portion thereof; and a plurality of spaced hinges, said hinges being located on a side edge of said central portion defined by said opening; and (b) a second rigid plate having a first side hingedly connected via said spaced hinges to said first rigid plate, said second plate having a shape substantially matching the shape of said central opening so when said second rigid plate is in a stowed position it may be supported within said central opening, said second plate including spaced projections formed on an upper surface thereof, said projections being so sized and spaced to align with said second set of spaced holes in said first plate when said second plate is rotated away from said stowed position so as to provide a holepunching capability when paper is inserted between said first plate and said second plate, wherein said holepunch capability may be utilized without a need for removing the notebook insert from a binder it may be attached to.

2. The notebook insert of claim 1 wherein said first plate has a second side edge of said central portion opposite said first side edge, said second edge having a recessed portion on an upper surface thereof; and, said second rigid plate has a second side with a recessed portion formed on a lower surface thereof, the recessed portion on said first plate matching the recessed portion on said second plate so that when said notebook insert is in a stowed position an upper surface of said second plate is maintained substantially flush with the unrecessed portions of the upper surface of said first plate.

3. The notebook insert of claim 1 further including a clock attached to said housing.

4. The notebook insert of claim 1 wherein said hinges provide 180 degree rotation of said second plate relative to said first plate thereby minimizing the total thickness of said apparatus.

5. A notebook insert, comprising:

(a) a housing comprising a first rigid plate with a plurality of holes therethrough, said holes being adapted for engagement with the rings of the ringed notebook;

(b) an electronic clock attached to said housing; and, (c) a second rigid plate hingedly attached to said first rigid plate, said first and second plates being capable of cooperating to provide a holepunch capability, said first plate, second plate, and clock being sufficiently thin for convenient use of the notebook insert in a ringed notebook.

6. A notebook insert, comprising:

(a) a housing comprising a first rigid plate with a plurality of holes therethrough, said holes being adapted for engagement with the rings of the ringed notebook; and, (b) an electronic clock attached to said housing.

* * * * *